US005134438A

United States Patent [19]

Nakashima

[11] Patent Number: 5,134,438

[45] Date of Patent: Jul. 28, 1992

[54] IMAGE FORMING APPARATUS HAVING A DEVICE FOR MEASURING AN ORIGINAL DENSITY

[75] Inventor: Naoki Nakashima, Kyoto, Japan

[73] Assignee: Mita Industrial Co., Ltd., Osaka, Japan

[21] Appl. No.: 769,386

[22] Filed: Oct. 1, 1991

[30] Foreign Application Priority Data

Oct. 13, 1990 [JP] Japan ..... 2-274055

[51] Int. Cl.[5] ..... G03G 21/00

[52] U.S. Cl. ..... 355/208; 355/214

[58] Field of Search ..... 355/208, 204, 203, 200, 355/210, 209, 228, 229, 214, 69

[56] References Cited

U.S. PATENT DOCUMENTS

| | | | |
|---|---|---|---|
| 4,465,358 | 8/1984 | Miura | 355/214 |
| 4,472,046 | 9/1984 | Kohyama | 355/203 X |
| 4,819,022 | 4/1989 | Kurando . | |
| 4,831,418 | 5/1989 | Ito et al. | 355/69 |
| 4,879,576 | 11/1989 | Naito | 355/214 |
| 4,910,554 | 3/1990 | Noda | 355/208 |
| 4,982,232 | 1/1991 | Naito | 355/208 |

*Primary Examiner*—A. T. Grimley
*Assistant Examiner*—Sandra L. Brasé
*Attorney, Agent, or Firm*—Beveridge DeGrandi & Weilacher

[57] ABSTRACT

An image forming apparatus is provided with an original density detecting device for detecting the original density, and output characteristic switching device for switching the output characteristic relative to the original density detected by the original density detecting device to a plurality of types of predetermined output characteristics. The original density is found on the basis of a predetermined output characteristic out of the plurality of output characteristics of the original density detecting device and an output of the original density detecting device. Then, an output characteristic showing a high rate of change in the vicinity of the original density found by the first original density measuring device out of the plurality of output characteristics is selected by selecting device. When the selected output characteristic is different from the output characteristic used for measuring the original density by the first original density measuring device, the output characteristic of the original density detecting device is switched to the selected output characteristic, and the original density is found on the basis of the selected output characteristic and the output of the original density detecting device by second original density measuring device.

13 Claims, 6 Drawing Sheets

IMAGE FORMING APPARATUS HAVING A DEVICE FOR MEASURING AN ORIGINAL DENSITY

BACKGROUND OF THE INVENTION

1. Field of the Invention

The present invention relates to image forming apparatuses such as a copying machine.

2. Description of the Prior Art

There has been conventionally known a copying machine for measuring the original density by prescanning and controlling, for example, the exposure value of a lamp for exposure on the basis of its measured value so as to do suitable printing irrespective of the original density.

The measurement of the original density is made by irradiating the lamp for exposure into an original and detecting the amount of its reflected light by a photoelectric converting device such as a photodiode at the time of prescanning.

FIG. 6 shows the output characteristics of an original density detecting device having a photodiode and an amplifier circuit for amplifying its output.

As obvious from FIG. 6, the rate of change in output of the original density detecting device is large in the range of a relatively low original density, while being small in the range of a relatively high original density.

Thus, the rate of change in output of the original density detecting device is small in the range of a relatively high original density. Accordingly, when the original density is relatively high, it is difficult to measure the precise original density.

In order to increase the rate of change in output of the original density detecting device in the range of a relatively high original density, it is considered that the illuminance of the lamp for exposure at the time of prescanning is made high. By doing so, however, the rate of change in output of the original density detecting device in the range of a relatively low original density becomes small, as shown in FIG. 7. Accordingly, when the original density is relatively low, it is difficult to measure the precise original density.

SUMMARY OF THE INVENTION

An object of the present invention is to provide an image forming apparatus capable of measuring the precise original density over the wide range from an original having a low density to an original having a high density.

In an image forming apparatus in which the original density is measured by prescanning and the image density is adjusted on the basis of the measured original density, a first image forming apparatus according to the present invention is characterized by comprising an original density detecting device for detecting the original density, output characteristic switching means for switching the output characteristic relative to the original density detected by the above original density detecting device to a plurality of types of predetermined output characteristics, first original density measuring means for finding the original density on the basis of one predetermined output characteristic out of the above plurality of types of output characteristics and an output of the above original density detecting device, selecting means for selecting an output characteristic showing a high rate of change in the vicinity of the original density found by the above first original density measuring means out of the above plurality of types of output characteristics, and second original density measuring means for switching the output characteristic of the above original density detecting device to the selected output characteristic and finding the original density on the basis of the selected output characteristic and the output of the above original density detecting device when the selected output characteristic is different from the output characteristic used for measuring the original density by the above first original density measuring means.

The density measured by the above first original density measuring means and the density measured by the above second original density measuring means are respectively used as the original density for adjusting the image density when the output characteristic selected by the above selecting means is the same as the output characteristic used for measuring the original density by the above first original density measuring means and when the output characteristic selected by the above selecting means is different from the output characteristic used for measuring the original density by the above first original density measuring means.

For example, the exposure value of a lamp for exposure at the time of exposure in copying processing is controlled on the basis of the density measured by the above first original density measuring means when the output characteristic selected by the above selecting means is the same as the output characteristic used for measuring the original density by the above first original density measuring means, while being controlled on the basis of the density measured by the above second original density measuring means when the output characteristic selected by the above slecting means is different from the output characteristic used for measuring the original density by the above first original density measuring means.

The above described original density detecting device is constituted by, for example, a photoelectric converting device and an amplifier circuit for amplifying its output. Used as the above output characteristic switching means is, for example, one for switching the exposure value of the lamp for exposure or one for switching the amplification factor of the above original density detecting device.

The measurement of the density by the above first original density measuring means is made, for example, at the time of forward movement of the lamp for exposure in prescanning. On the other hand, the measurement of the density by the second original density measuring means is made, for example, at the time of backward movement of the lamp for exposure in prescanning.

The above output characteristic switching means may be one for switching the output characteristic of the above original density detecting device to two types of output characteristics. The above selecting means may be one for determining whether the original density measured by the above first original density measuring means is higher or lower than a predetermined density for determination to select an output characteristic showing a high rate of change in the vicinity of the original density measured by the above first original density measuring means.

In the first image forming apparatus according to the present invention, the original density is found on the basis of one predetermined output characteristic out of a plurality of predetermined output characteristics of the original density detecting device and an output of the original density detecting device by the first original density measuring means at the time of prescanning. Then, an output characteristic showing a high rate of change in the vicinity of the original density found by the first original density measuring means out of the plurality of output characteristics is selected by the selecting means. When the selected output characteristic is different from the output characteristic used for measuring the original density by the first original density measuring means, the output characteristic of the density detecting device is switched to the selected output characteristics, and the original density is found on the basis of the selected output characteristic and the output of the original density detecting device by the second original density measuring means.

In the first image forming apparatus according to the present invention, the output characteristic relative to the original density detected by the original density detecting device is switched to a plurality of types of predetermined output characteristics, and the original density is measured on the basis of an output characteristic showing a high rate of change in the vicinity of the original density. Accordingly, it is possible to measure the precise original density over the wide range from an original having a low density to an original having a high density.

In an image forming apparatus in which the original density is measured by prescanning and the image density is adjusted on the basis of the measured original density, a second image forming apparatus according to the present invention is characterized by comprising a plurality of original density detecting devices which differ in output characteristics relative to the original density, first original density measuring means for finding the original density on the basis of an output of one predetermined original density detecting device out of the above plurality of original density detecting devices, selecting means for selecting an output characteristic showing a high rate of change in the vicinity of the original density found by the above first original density measuring means out of the output characteristics of the above plurality of original density detecting devices, and second original density measuring means for finding the original density on the basis of an output of the original density detecting device having the output characteristic selected by the above selecting means when the selected output characteristic is different from the output characteristic of the original density detecting device used for measuring the original density by the above first original density measuring means.

The density measured by the first original density measuring means and the density measured by the above second original density measuring means are respectively used as the original density for adjusting the image density when the output characteristic selected by the above slecting means is the same as the output characteristic of the original density detecting device used for measuring the original density by the above first original density measuring means and when the output characteristic selected by the above selecting means is different from the output characteristic of the original density detecting device used for measuring the original density by the above first original density measuring means.

For example, the exposure value of a lamp for exposure at the time of exposure in copying processing is controlled on the basis of the density measured by the first original density measuring means when the output characteristic selected by the above selecting means is the same as the output characteristic of the original density detecting device used for measuring the original density by the above first original density measuring means, while being controlled on the basis of the density measured by the above second density measuring means when the output characteristic selected by the above selecting means is different from the output characteristic of the original density detecting device used for measuring the original density by the above first original density measuring means.

The output characteristic relative to the original density detected by each of the above described original density detecting devices may be changed by constituting each of the original density detecting devices by a photoelectric converting device and an amplifier circuit for amplifying its output, using as the photoelectric converting devices in the original density detecting devices ones having the same output characteristic, and using as the amplifier circuits in the original density detecting devices ones having different amplification factors.

Two original density detecting devices which differ in output characteristics relative to the original density may be provided, and used as the above selecting means may be one for determining whether the original density measured by the above first original density measuring means is higher or lower than a predetermined density for determination to select an output characteristic showing a high rate of change in the vicinity of the original density found by the above first original density measuring means.

The second image forming apparatus according to the present invention is provided with a plurality of original density detecting devices which differ in output characteristics relative to the original density. At the time of prescanning, the original density is found on the basis of an output of one predetermined original density detecting device out of the plurality of original density detecting devices by the first original density measuring means. An output characteristic showing a high rate of change in the vicinity of the original density found by the first original density measuring means out of the output characteristics of the plurality of original density detecting devices is selected by the selecting means. When the output characteristic selected by the selecting means is different from the output characteristic of the original density detecting device used for measuring the original density by the first original density measuring means, the original density is found on the basis of the output of the original density detecting device having the output characteristic selected by the selecting means.

The second image forming apparatus according to the present invention is provided with a plurality of original density detecting devices which differ in output characteristics relative to the original density to measure the original density on the basis of an output of the original density detecting device having an output characteristic showing a high rate of change in the vicinity of the original density. Accordingly, it is possible to measure the precise original density over the wide range from an original having a low density to a original having a high density.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a block diagram showing the electrical construction of a copying machine, FIG. 2 is a graph showing the output characteristics of an original density detecting device, and FIG. 3 is a flow chart showing processing for measuring the original density performed at the time of prescanning;

FIG. 4 is a block diagram showing the electrical construction of a copying machine, and FIG. 5 is a flow chart showing processing for measuring the original density performed at the time of prescanning;

DESCRIPTION OF THE PREFERRED EMBODIMENTS

Description is now made of embodiments of the present invention with reference to the drawings.

Figure 1:
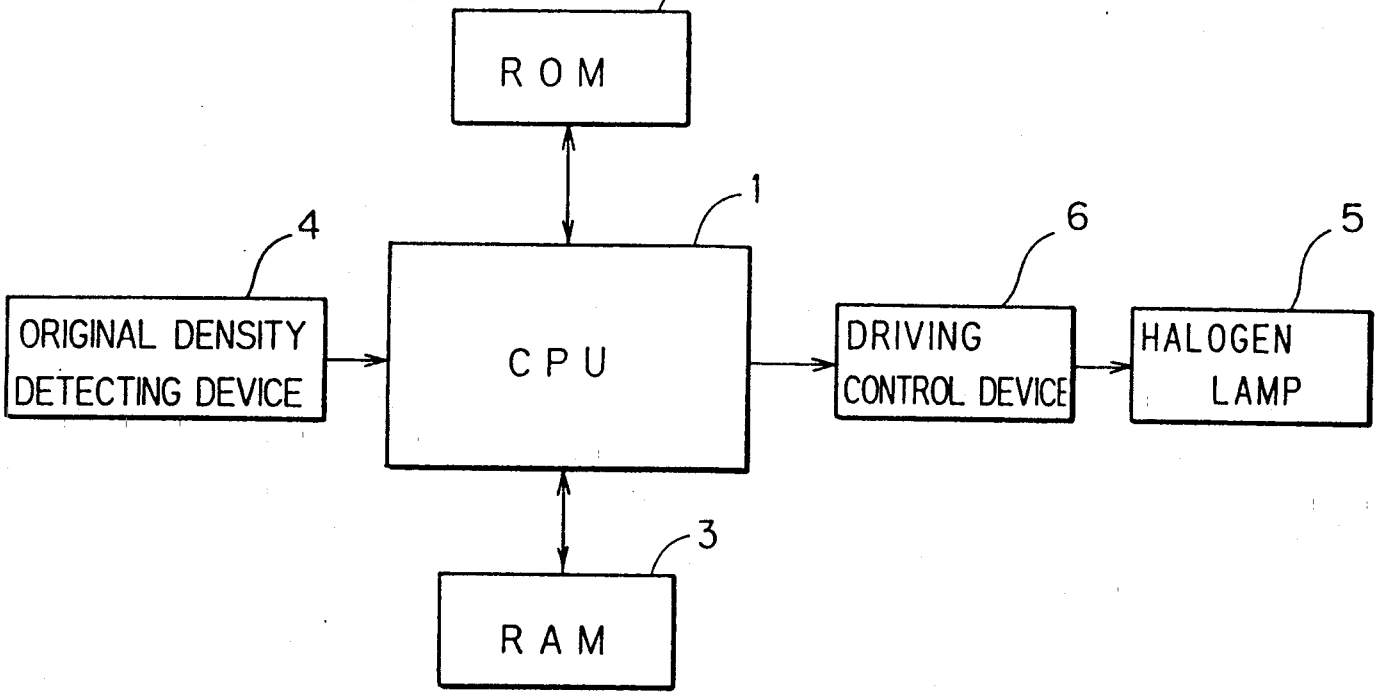
FIGS. 1 to 3 show a first embodiment of the present invention, where
Figure 2:
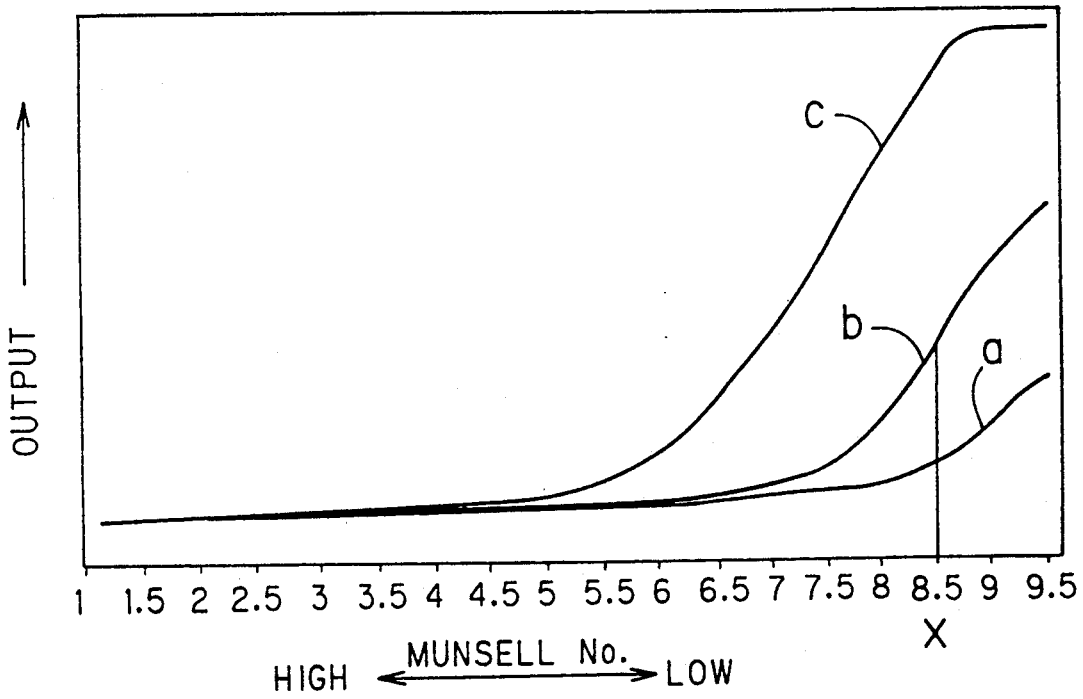
Figure 3:
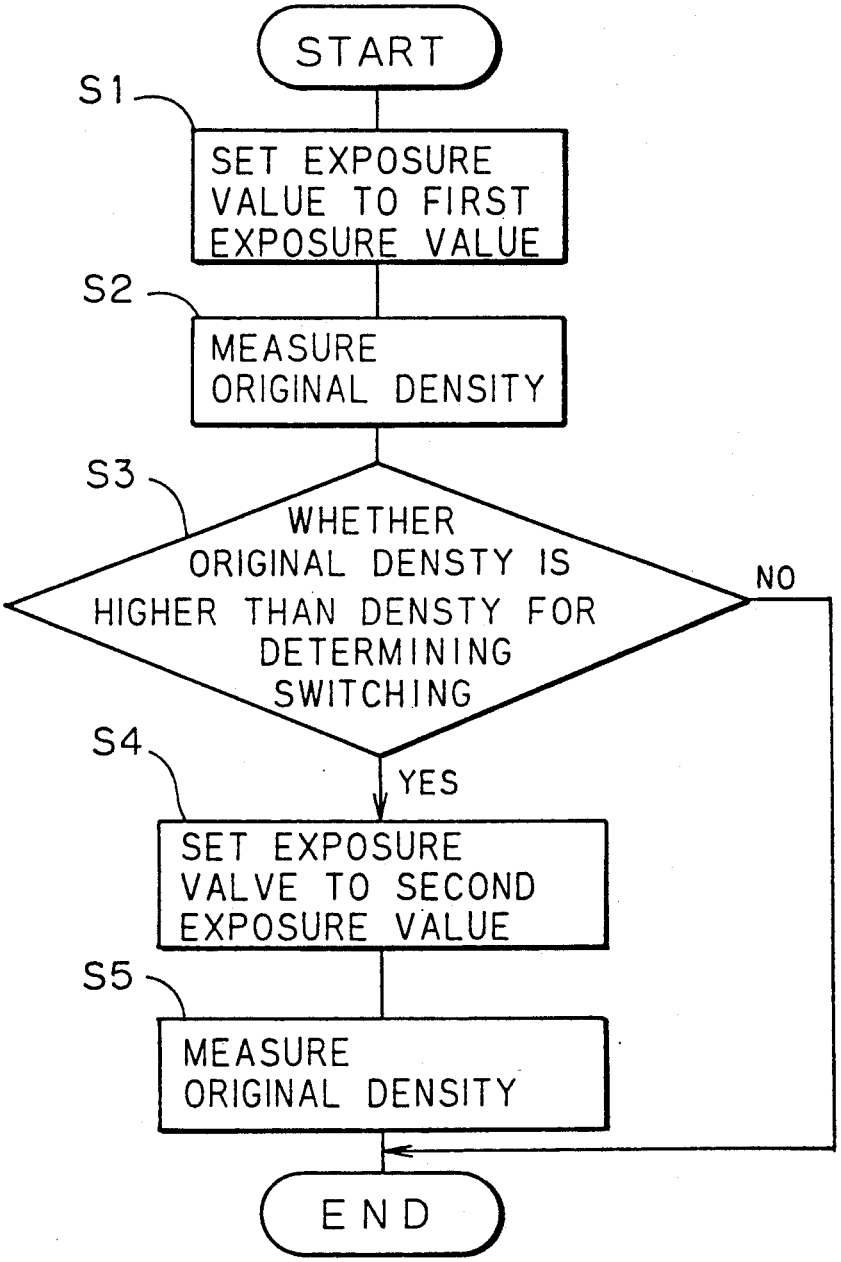

FIGS. 1 to 3 show a first embodiment of the present invention.

FIG. 1 shows the electrical construction of a copying machine.

The copying machine is controlled by a CPU 1. The CPU 1 comprises a ROM 2 for storing its program and the like and a RAM 3 for storing necessary data.

An original density detecting device 4 for detecting the original density, a driving control device 6 of a halogen lamp for exposure 5, and other equipments (not shown) are connected to the CPU 1. The original density detecting device 4 comprises a photoelectric converting device such as a photodiode and an amplifier circuit for amplifying its output.

FIG. 2 shows the output characteristics of the original density detecting device 4 relative to the original density.

In FIG. 2, a curve a is a characteristic curve in a case where a voltage applied to the halogen lamp 5 at the time of prescanning is 55 [V], a curve b is a characteristic curve in a case where a voltage applied to the halogen lamp 5 at the time of prescanning is 65 [V], and a curve c is a characteristic curve in a case where a voltage applied to the halogen lamp 5 at the time of prescanning is 75 [V].

In the present embodiment, 65 [V](the exposure value of the halogen lamp 5 in this case is referred to as a first exposure value hereinafter) is set as the voltage applied to the halogen lamp 5 at the time of prescanning. The original density is found on the basis of an output characteristic represented by the curve b. When the original density is higher than a predetermined density X for determining switching of the exposure value, that is, Munsell Number is smaller than 8.5, the voltage applied to the halogen lamp 5 is switched to 75 [V](the exposure value of the halogen lamp 5 in this case is referred to as a second exposure value hereinafter) so as to measure the original density using the characteristic curve c showing a high rate of change in the density range, so that the original density is measured on the basis of an output characteristic represented by the curve c.

FIG. 3 shows processing for measuring the density performed at the time of prescanning.

First, the exposure value of the halogen lamp 5 is set to the first exposure value (the voltage applied to the halogen lamp 5 is 65 [V]) (step S1). When prescanning is started, the original density is found on the basis of an output signal of the original density detecting device 4 and the output characteristic represented by the curve b in the forward route of prescanning (step S2). The original density found is stored in a buffer.

It is then determined whether the original density found is higher or lower than the density X for determining switching of the exposure value (step S3).

If the original density is lower than the density X for determining switching of the exposure value, this processing is terminated. At the time of exposure in copying processing performed after this processing is terminated, the exposure value of the halogen lamp 5 is controlled on the basis of the original density found in the above step S2.

When the original density is higher than the density X for determining switching of the exposure value, the exposure value of the halogen lamp 5 is switched to the second exposure value (the voltage applied to the halogen lamp 5 is 75 [V]) in the backward route of prescanning (step S4). The original density is found on the basis of the output signal of the original density detecting device 4 and the output characteristic represented by the curve c in the backward route of prescanning (step S5). The original density found is stored in the buffer as the precise original density, to terminate this processing. At the time of exposure in copying processing performed after this processing is terminated, the exposure value of the halogen lamp 5 is controlled on the basis of the original density found in the above step S5.

Although in the above described first embodiment, the exposure value of the halogen lamp 5 at the time of prescanning is switched so as to switch the output characteristic of the original density detecting device 4, the amplification factor of the amplifier circuit in the original density detecting device 4 may be switched instead of switching the exposure value of the halogen lamp 5.

Furthermore, the output characteristic of the original density detecting device 4 may be switched to three or more types of output characteristics. In this case, the output characteristic of the original density detecting device 4 is first set to a predetermined output characteristic, to measure the original density. When an output characteristic showing a high rate of change in the vicinity of the original density measured is different from the above output characteristic first set, the output characteristic of the original density detecting device 4 is switched to the output characteristic having a large rate of change in the vicinity of the original density measured, to measure the original density.

Figure 4:
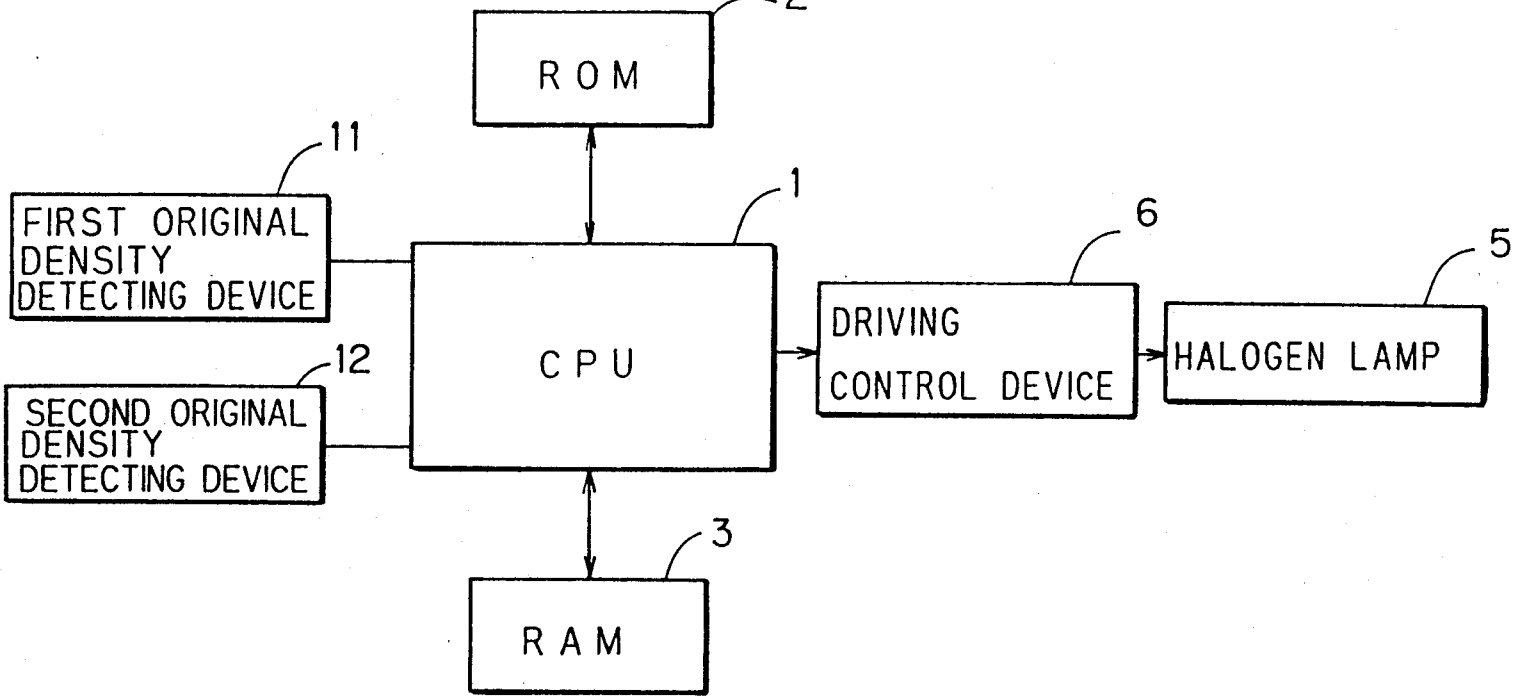
FIGS. 4 and 5 show a second embodiment of the present invention, where
Figure 5:
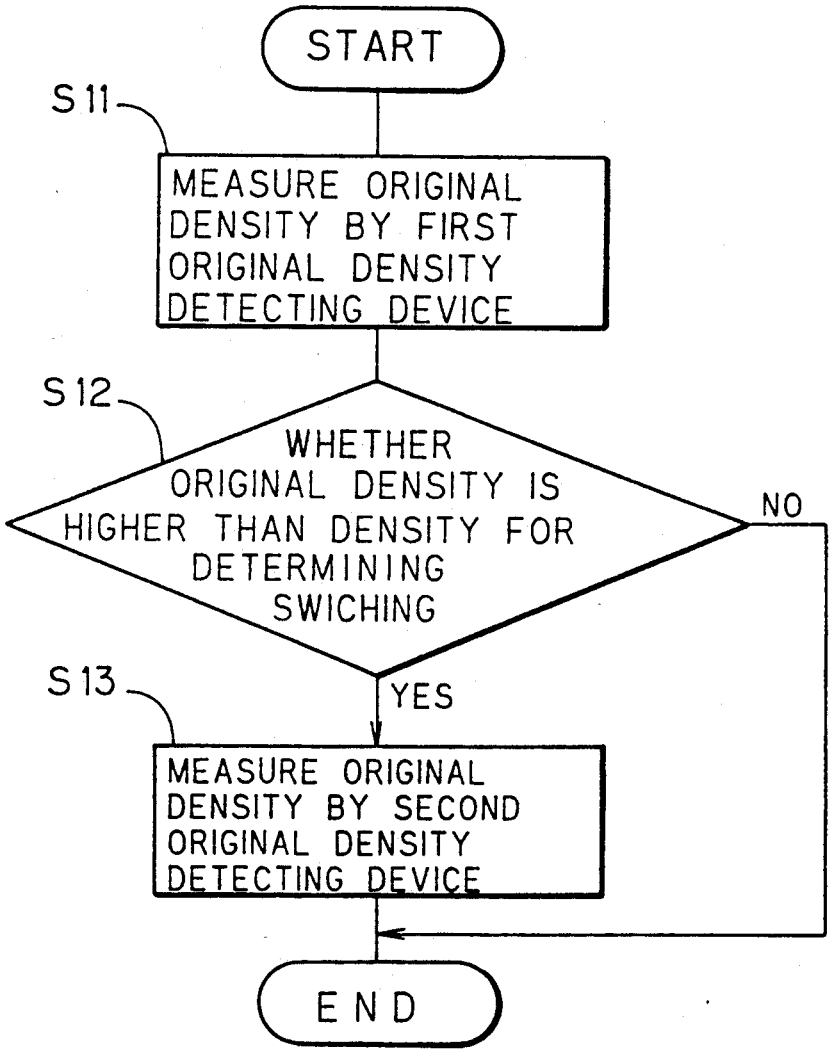
Figure 6:
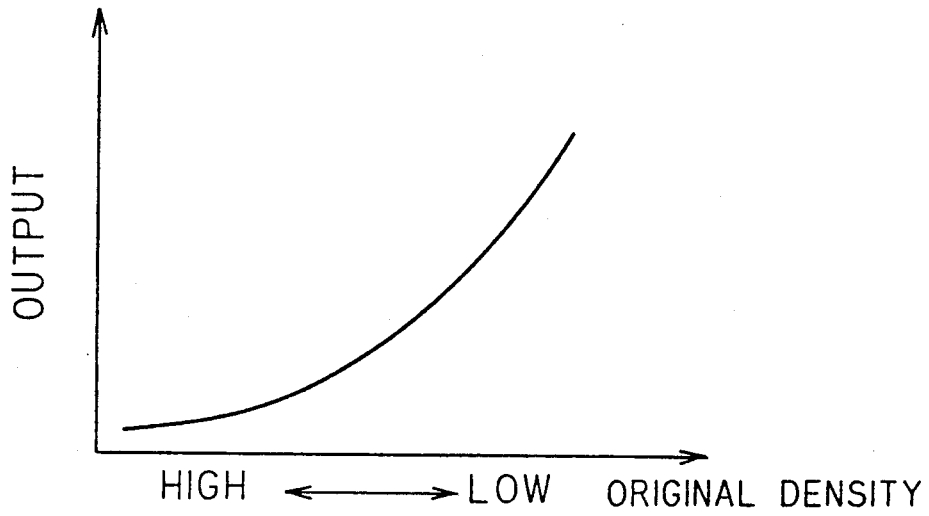
FIG. 6 is a graph showing the output characteristic of an original density detecting device.
Figure 7:
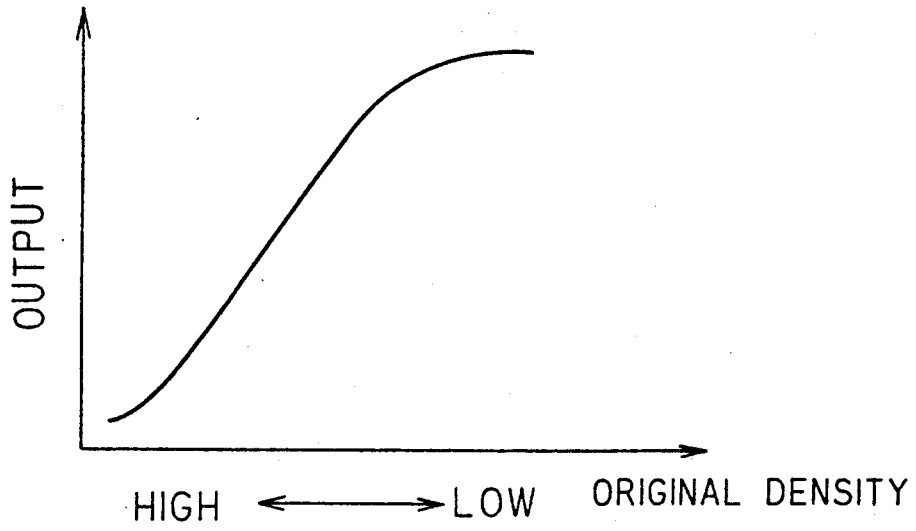
FIG. 7 is a graph showing the output characteristic of the original density detecting device in a case where the illuminance of a lamp for exposure is made high.

FIGS. 4 and 5 show a second embodiment of the present invention.

FIG. 4 shows the electrical construction of a copying machine. In FIG. 4, the same reference numerals are assigned to the same portions as those shown in FIG. 1 and hence, the description thereof is omitted. This copying machine comprises first and second original density detecting devices 11 and 12 for detecting the original density. Each of the original density detecting devices 11 and 12 comprises a photoelectric converting device such as a photodiode and an amplifier circuit for amplifying its output.

Both the photodiodes in the original density detecting devices 11 and 12 have the same characteristic. The amplification factors of the amplifier circuits in the original density detecting devices 11 and 12 are different from each other. More specifically, when $\alpha 1$ is taken as the amplification factor of the amplifier circuit in the first original density detecting device 11 and $\alpha 2$ is taken as the amplification factor of the amplifier circuit in the second original density detecting device 12, $\alpha 2$ is set to be larger than $\alpha 1$ ($\alpha 1 < \alpha 2$).

In this case, the amplification factors $\alpha 1$ and $\alpha 2$ are so determined that the output characteristic of the first original density detecting device 11 approximates the curve b shown in FIG. 2 and the output characteristic of the second original density detecting device 12 approximates the curve c shown in FIG. 2 when the exposure value of a halogen lamp 5 at the time of prescanning is a predetermined constant value.

FIG. 5 shows processing for measuring the density performed at the time of prescanning.

First, when prescanning is started, the original density is found on the basis of an output signal of the first original density detecting device 11 and the output characteristic represented by the curve b (see FIG. 2), to be stored in a buffer (step S11).

It is then determined whether the original density found is higher or lower than a density X for determining switching of detecting devices (see FIG. 2) (step S12).

If the original density is lower than the density X for determining switching of detecting devices, this processing is terminated. At the time of exposure in copying processing performed after the processing is terminated, the exposure value of the halogen lamp 5 is controlled on the basis of the original density found in the above step S11.

If the original density found in the above step S11 is higher than the density X for determining switching of detecting devices, the original density is found on the basis of an output signal of the second original density detecting device 12 and the output characteristic represented by the curve c, to be stored in the buffer (step S13), to terminate this processing. At the time of exposure in copying processing performed after the processing is terminated, the exposure value of the halogen lamp 5 is controlled on the basis of the original density found in the above step S13.

Although in the above described second embodiment, there are provided two original density detecting devices which differ in output characteristics, three or more original density detecting devices which differ in output characteristics may be provided to use as the precise original density the density measured by the original density detecting device having a large output characteristic showing a high rate of change in the vicinity of the density measured on the basis of a detection output of a predetermined original density detecting device.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In an image forming apparatus in which the original density is measured by prescanning and the image density is adjusted on the basis of the measured original density, the image forming apparatus being characterized by comprising:

an original density detecting device for detecting the original density;

output characteristic switching means for switching the output characteristic relative to the original density detected by said original density detecting device to a plurality of types of predetermined output characteristics;

first original density measuring means for finding the original density on the basis of one predetermined output characteristic out of said plurality of types of output characteristics and an output of said original density detecting device;

selecting means for selecting an output characteristic showing a high rate of change in the vicinity of the original density found by said first original density measuring means out of said plurality of types of output characteristics; and second original density measuring means for switching the output characteristic of said original density detecting device to the selected output characteristic and finding the original density on the basis of the selected output characteristic and the output of said original density detecting device when the selected output characteristic is different from the output characteristic used for measuring the original density by said first original density measuring means.

2. The image forming apparatus according to claim 1, wherein the density measured by said first original density measuring means and the density measured by said second original density measuring means are respectively used as the original density for adjusting the image density when the output characteristic selected by said selecting means is the same as the output characteristic used for measuring the original density by said first original density measuring means and when the output characteristic selected by said selecting means is different from the output characteristic used for measuring the original density by said first original density measuring means.

3. The image forming apparatus according to claim 1, wherein the exposure value of a lamp for exposure at the time of exposure in copying processing is controlled on the basis of the density measured by said first original density measuring means when the output characteristic selected by said selecting means is the same as the output characteristic used for measuring the original density by said first original density measuring means, while being controlled on the basis of the density measured by said second original density measuring means when the output characteristic selected by said selecting means is different from the output characteristic used for measuring the original density by said first original density measuring means.

4. The image forming apparatus according to claim 1, wherein said original density detecting device comprises a photoelectric converting device and an amplifier circuit for amplifying its output.

5. The image forming apparatus according to claim 1, wherein said output characteristic switching means is for switching the exposure value of the lamp for exposure.

6. The image forming apparatus according to claim 4, wherein said output characteristic switching means is for switching the amplification factor of said original density detecting device.

7. The image forming apparatus according to claim 1, wherein the measurement of the density by said first original density measuring means is made at the time of forward movement of the lamp for exposure in prescanning, and the measurement of the density by said second original density measuring means is made at the time of backward movement of said lamp for exposure in prescanning.

8. The image forming apparatus according to claim 1, wherein said output characteristic switching means is for switching the output characteristic of said original density detecting device to two types of output characteristics, and said selecting means determines whether the original density measured by said first original density measuring means is higher or lower than a predetermined density for determination to select an output characteristic showing a high rate of change in the vicinity of the original density measured by said first original density measuring means.

9. In an image forming apparatus in which the original density is measured by prescanning and the image density is adjusted on the basis of the measured original density, the image forming apparatus being characterized by comprising:

a plurality of original density detecting devices which differ in output characteristics relative to the original density;

first original density measuring means for finding the original density on the basis of an output of one predetermined original density detecting device out of said plurality of original density detecting devices;

selecting means for selecting an output characteristic showing a high rate of change in the vicinity of the original density found by said first original density measuring means out of the output characteristics of said plurality of original density detecting devices; and second original density measuring means for finding the original density on the basis of an output of the original density detecting device having the output characteristic selected by said selecting means when the selected output characteristic is different from the output characteristic of the original density detecting device used for measuring the original density by said original density measuring means.

10. The image forming apparatus according to claim 9, wherein the density measured by said first original density measuring means and the density measured by said second original density measuring means are respectively used as the original density for adjusting the image density when the output characteristic selected by said selecting means is the same as the output characteristic of the original density detecting device used for measuring the original density by the first original density measuring means and when the output characteristic selected by said selecting means is different from the output characteristic of the original density detecting device used for measuring the original density by the first original density measuring means.

11. The image forming apparatus according to claim 9, wherein the exposure value of a lamp for exposure at the time of exposure in copying processing is controlled on the basis of the density measured by the first original density measuring means when the output characteristic selected by said selecting means is the same as the output characteristic of the original density detecting device used for measuring the original density by said first original density measuring means, while being controlled on the basis of the density measured by said second original density measuring means when the output characteristic selected by said selecting means is different from the output characteristic of the original density detecting device used for measuring the original density by said first original density measuring means.

12. The image forming apparatus according to claim 9, wherein each of said original density detecting devices comprises a photoelectric converting device and an amplifier circuit for amplifying its output, and the output characteristics of the photoelectric converting devices in said original density detecting devices are the same and the amplification factors of the amplifier circuits in said original density detecting devices are different from each other.

13. The image forming apparatus according to claim 9, wherein there are provided two original density detecting devices which differ in output characteristics relative to the original density, and said selecting means determines whether the original density measured by said first original density measuring means is higher or lower than a predetermined density for determination to select an output characteristic showing a high rate of change in the vicinity of the original density found by said first original density measuring means.

* * * * *